US008876109B2

(12) United States Patent
Kitamura

(10) Patent No.: US 8,876,109 B2
(45) Date of Patent: Nov. 4, 2014

(54) MEDIUM FEEDING DEVICE AND IMAGE FORMING APPARATUS

(75) Inventor: Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 313 days.

(21) Appl. No.: 13/074,078

(22) Filed: Mar. 29, 2011

(65) Prior Publication Data

US 2011/0241277 A1 Oct. 6, 2011

(30) Foreign Application Priority Data

Mar. 30, 2010 (JP) ..... 2010-079671

(51) Int. Cl.

| | |
|---|---|
| ***B65H 5/00*** | (2006.01) |
| ***B65H 3/52*** | (2006.01) |
| ***B65H 3/68*** | (2006.01) |
| ***B65H 3/06*** | (2006.01) |
| ***B65H 3/66*** | (2006.01) |

(52) U.S. Cl.

CPC ..... *B65H 3/5223* (2013.01); *B65H 3/68* (2013.01); *B65H 2404/6111* (2013.01); *B65H 2404/513* (2013.01); *B65H 3/0607* (2013.01); *B65H 3/66* (2013.01)

USPC ..... 271/264

(58) Field of Classification Search

USPC ..... 271/264

See application file for complete search history.

(56) References Cited

U.S. PATENT DOCUMENTS

| | | | | |
|---|---|---|---|---|
| 8,246,037 | B2 * | 8/2012 | Huang et al. | 271/3.14 |
| 8,267,400 | B2 * | 9/2012 | Nishikata et al. | 271/264 |
| 2005/0017441 | A1 * | 1/2005 | Sugiyama | 271/264 |
| 2008/0251991 | A1 | 10/2008 | Doyo | |
| 2009/0121422 | A1 * | 5/2009 | Imoto | 271/272 |
| 2009/0134571 | A1 * | 5/2009 | Kotaka | 271/264 |
| 2009/0243205 | A1 * | 10/2009 | Ishioka | 271/264 |
| 2009/0324311 | A1 * | 12/2009 | Matsumoto | 399/400 |
| 2010/0123282 | A1 * | 5/2010 | Miyakoshi | 271/3.19 |
| 2010/0303529 | A1 * | 12/2010 | Shiba | 399/388 |
| 2010/0314827 | A1 * | 12/2010 | Nishii et al. | 271/264 |
| 2011/0109038 | A1 * | 5/2011 | Nishizawa et al. | 271/226 |

FOREIGN PATENT DOCUMENTS

| | | | |
|---|---|---|---|
| JP | 60258039 | A | 12/1985 |
| JP | 01321234 | A | 12/1989 |
| JP | 08040577 | A | 2/1996 |
| JP | 2004123316 | A | 4/2004 |
| JP | 2008-280179 | A | 11/2008 |
| JP | 2010-111486 | A | 5/2010 |

* cited by examiner

*Primary Examiner* — Prasad Gokhale

(74) *Attorney, Agent, or Firm* — Panitch Schwarze Belisario & Nadel LLP

(57) ABSTRACT

A medium feeding device includes a medium feeding unit that feeds a medium by contacting the medium, a separating unit that presses the medium against the medium feeding unit to separate the medium from subsequent media, and a conveying unit that conveys the medium having been separated by the separating unit. A first guide member is provided between the medium feeding unit and the conveying unit, and configured to guide a surface of the medium on the medium feeding unit side. A second guide member provided is so as to face the first guide member, and configured to guide the medium. The first guide member has a guide protruding portion that protrudes toward the second guide member.

20 Claims, 11 Drawing Sheets

COMPARISON EXAMPLE

COMPARISON EXAMPLE

COMPARISON EXAMPLE

COMPARISON EXAMPLE

COMPARISON EXAMPLE

COMPARISON EXAMPLE

COMPARISON EXAMPLE

COMPARISON EXAMPLE

MEDIUM FEEDING DEVICE AND IMAGE FORMING APPARATUS

BACKGROUND OF THE INVENTION

The present invention relates to a medium feeding device that feeds a medium, and an image forming apparatus using the medium feeding device.

In a conventional medium feeding device, a stack of media (such as sheets) is stored in a medium storing portion. Each medium is separated from the other media (i.e., subsequent media) and fed out of the medium storing portion by a feeding roller and a separating unit. The medium fed out of the medium storing portion is further conveyed by a conveying roller pair.

In order to prevent generation of wrinkles on the medium, there is proposed a configuration in which an anti-wrinkle roller and an anti-wrinkle guide are disposed on a medium conveying path between the feeding roller and the conveying roller pair. The anti-wrinkle roller and the anti-wrinkle guide are provided so as to form a narrow gap therebetween through which the medium passes (see, for example, Patent Document No. 1).

Patent Document No. 1: Japanese Laid-open Patent Publication No. 2004-123316 (see, paragraphs 0018 to 0024, FIGS. 1 and 3)

The anti-wrinkle roller and the anti-wrinkle guide are configured to sandwich the medium therebetween to thereby extend the medium in a widthwise direction so as to prevent generation of wrinkles (i.e., to prevent poor printing due to wrinkles).

Recently, there is a demand for a technology capable of stably feeding the medium while preventing generation of wrinkles.

SUMMARY OF THE INVENTION

The present invention is intended to provide a medium feeding device and an image forming apparatus capable of stably feeding a medium and preventing generation of wrinkles on the medium.

According to an aspect of the present invention, there is provided a medium feeding device including a medium feeding unit that feeds a medium by contacting the medium, a separating unit that presses the medium against the medium feeding unit to separate the medium from subsequent media, and a conveying unit that conveys the medium having been separated by the separating unit. A first guide member is provided between the medium feeding unit and the conveying unit, and configured to guide a surface of the medium on the medium feeding unit side. A second guide member is provided so as to face the first guide member, and configured to guide the medium. The first guide member has a guide protruding portion that protrudes toward the second guide member.

With such a configuration, generation of wrinkles on the medium can be prevented, and a feeding failure of the medium can be prevented.

According to another aspect of the present invention, there is provided a medium feeding device including a medium feeding unit that feeds a medium by contacting the medium, a separating unit that presses the medium against the medium feeding unit to separate the medium from subsequent media, and a conveying unit that conveys the medium having been separated by the separating unit. A first guide member is provided between the medium feeding unit and the conveying unit, and configured to guide a surface of the medium on the medium feeding unit side. A second guide member is provided so as to face the first guide member, and configured to guide the medium. The first guide member and the second guide member face each other with a gap formed therebetween, and the gap is narrower at a part in the vicinity of a downstream side of the medium feeding unit than the other parts of the gap.

According to still another aspect of the present invention, there is provided an image forming apparatus including the above described medium feeding device.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

Figure 1:
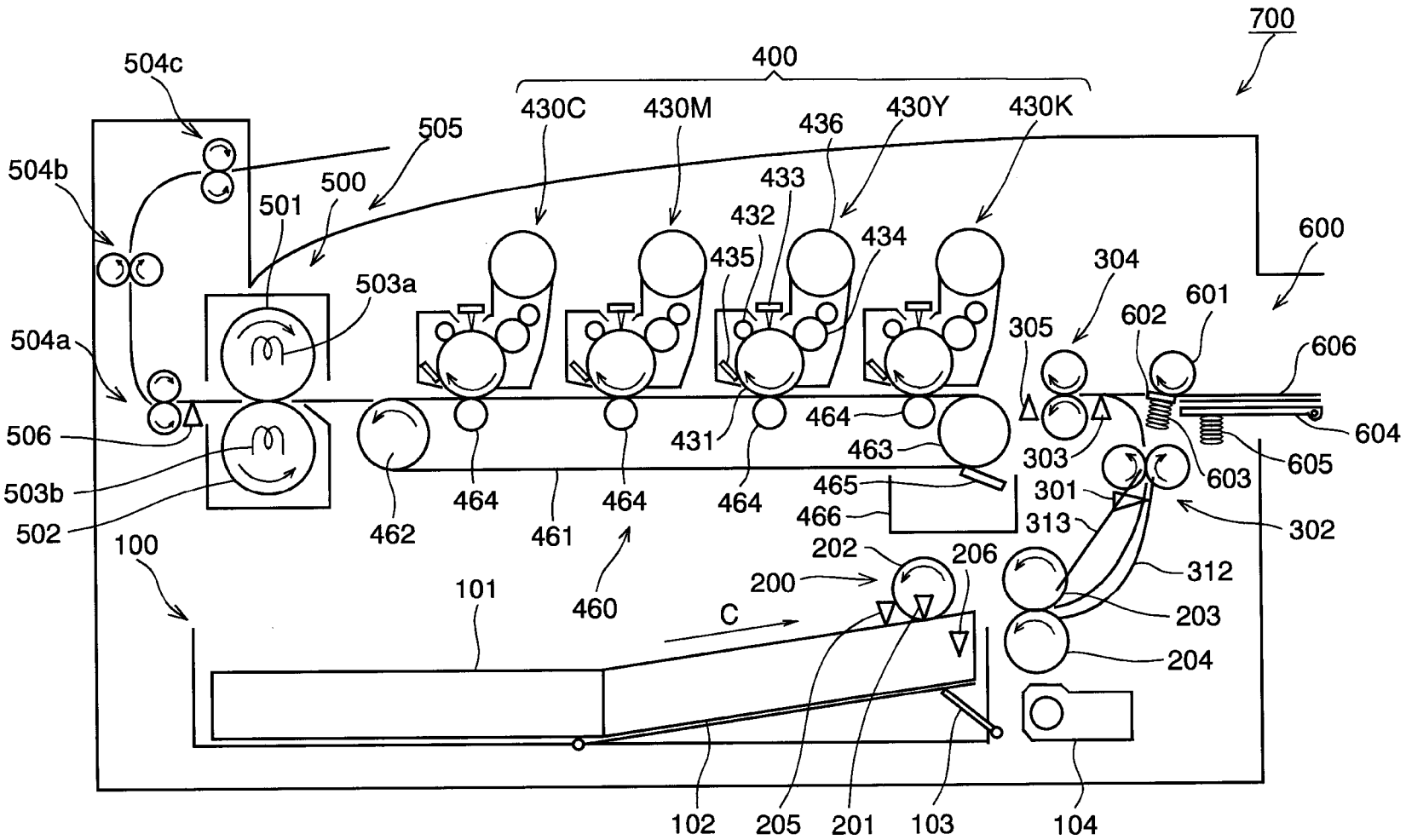
FIG. 1 is a schematic sectional view showing a configuration of an image forming apparatus according to the first embodiment of the present invention.

FIG. 1 is a schematic sectional view showing a configuration of an image forming apparatus 700 according to the first embodiment of the present invention.

The image forming apparatus 700 is configured as, for example, an electrophotographic printer that forms an image on a sheet (more specifically, printing sheet) 101 as a medium.

The image forming apparatus 700 includes a sheet tray 100 that stores the sheets 101. The sheet tray 100 is detachably mounted to a lower part of the image forming apparatus 700. The sheet tray 100 has a sheet placing plate 102 provided therein. The sheet placing plate 102 is rotatably supported by a not shown supporting shaft, and a stack of the sheets 101 is placed on the sheet placing plate 102.

A rotatable lift-up lever 103 is provided on a sheet-feeding side (i.e., right in FIG. 1) of the sheet tray 100. The lift-up lever 103 is fixed to a not shown rotation shaft which is disconnectably connected to a motor 104. Further, a pickup roller 202 is provided above the sheet placing plate 102.

When the sheet tray 100 is mounted to the image forming apparatus 700, the lift-up lever 103 is connected to the motor 104, and the motor 104 is driven by a not shown controller such as a CPU (Central Processing Unit).

The lift-up lever 103 is rotated by the motor 104, and an end of the lift-up lever 103 pushes the sheet placing plate 102 upward, and the stack of the sheets 101 on the sheet placing plate 102 moves upward. When the stack of the sheets 101 reaches a predetermined height, the uppermost sheet 101 of the stack contacts the pickup roller 202. An upward movement detecting portion 201 detects that the uppermost sheet 101 contacts the pickup roller 202. The controller stops the motor 104 based on information from the upward movement detecting portion 201.

A supplying roller 203 and a retard roller 204 are provided in the vicinity of the pickup roller 202. The supplying roller 203 and the retard roller 204 contact each other. The pickup roller 202, the supplying roller 203 and the retard roller 204 constitute a sheet feeding portion 200.

The pickup roller 202 and the supplying roller 203 rotate in directions shown by arrows in FIG. 1 by a not shown motor. The pickup roller 202 and the supplying roller 203 respectively have one-way clutches therein, and can freely rotate in the directions shown by the arrows even when the motor is stopped. The retard roller 204 generates a torque in a direction shown by an arrow in FIG. 1 by means of a not shown torque generating unit.

With such a configuration, the pickup roller 202 takes out the sheet 101 from the sheet tray 100. The supplying roller 203 and the retard roller 204 feed the sheet 101 one by one into a conveying path, even when a plurality of sheets 101 are taken out by the pickup roller 202 at the same time.

On a downstream side of the sheet feeding portion 200 along the conveying path of the sheet 101, guide members 312 and 313, a sheet sensor 301, a conveying roller pair 302, a sheet sensor 303, a conveying roller pair 304 and a writing sensor 305 are arranged in this order in a conveying direction of the sheet 101 shown by an arrow C.

The guide members 312 and 313 guide the sheet 101 from the feeding portion 200 to the conveying roller pair 302. The conveying roller pair 302 conveys the sheet 101 while correcting the skew of the sheet 101. The conveying roller pair 304 further conveys the sheet 101 to an image forming portion 400. The sheet sensors 301, 303 and 305 detect the passage of the sheet 101 conveyed along the conveying path. The sheet sensor 303 is used to determine a timing to start rotating the conveying roller pair 304. The writing sensor 305 is used to determine to start writing (exposure) in the image forming portion 400.

A multi-purpose tray (hereinafter, referred to as MPT) 600 with a medium feeding device according to the first embodiment is provided on a right side of the image forming portion 700. The MPT 600 is configured to store sheets (for example, printing sheets) 606 as media, and to feed the sheets 606 one by one to a main body of the image forming apparatus 700.

The MPT 600 includes a sheet placing plate 604 as a medium placing plate on which a stack of the sheets 606 is placed, and a sheet feeding roller 601 as a medium feeding unit that contacts the uppermost sheet 606 of the stack placed on the sheet placing plate 604 and feeds the sheet 606 out of the sheet placing plate 604. The MPT 600 further includes a friction pad 602 as a separating unit that presses the sheet 606 (being fed by the sheet feeding roller 601) against the sheet feeding roller 601 so as to separate the sheet 606 from the subsequent sheets 606. Detailed descriptions of the MPT 600 will be made later.

The image forming portion 400 includes four process units 430K, 430Y, 430M and 430C respectively forming images of black, yellow, magenta and cyan. The process units 430K, 430Y, 430M and 4300 are arranged in this order from upstream to downstream along the conveying path of the sheet 101 (606). The process units 430K, 430Y, 430M and 4300 have the same configuration, and therefore the configuration of the yellow process unit 430Y will be herein described as an example.

The process unit 430Y includes a photosensitive drum 341 as an image bearing body which is rotatable in a direction shown by an arrow in FIG. 1. Along a circumference of the photosensitive drum 431, a charging roller 432 as a charging member, an exposure device 433, a developing roller 434 as a developer bearing body, and a cleaning blade 434 as a cleaning member are arranged in this order in a rotational direction of the photosensitive drum 431. The charging roller 432 uniformly charges a surface of the photosensitive drum 431 by supplying electric charge thereto. The exposure device 433 emits light to irradiate the surface of the photosensitive drum 431 so as to form a latent image thereon. The developing roller 434 develops the latent image by causing a yellow toner (i.e., a developer) to adhere to the surface of the photosensitive drum 431 on which the latent image is formed. The cleaning blade 435 removes a residual toner that remains on the surface of the photosensitive drum 431 after transferring of the toner to the medium 101 (606).

Further, a toner storing portion 436 as a developer storing portion is mounted to an upper part of the process unit 430Y. The toner storing portion 436 stores the toner as a developer, and supplies the toner to the developing roller 434.

The photosensitive drums 431 and the rollers of the process units 430K, 430Y, 430M and 430C are rotated by power transmitted from a driving source (not shown) via gears or the like.

Transfer rollers 464 are pressed against the photosensitive drums 431 of the process units 430K, 430Y, 430M and 430C via a transfer belt 461. Each transfer roller 464 has a conductive layer formed of rubber or the like. Each transfer roller 464 is applied with a voltage for generating a difference between surface potentials of the photosensitive drum 431 and the transfer roller 464 for transferring the toner image from the photosensitive drum 431 to the sheet 101 (606).

The transfer belt 461 electrostatically absorbs and conveys the sheet 101 (606). The transfer belt 461 is stretched around a driving roller 462 and a tensioning roller 463. The driving roller 462 rotates to move the transfer belt 461. A cleaning blade 465 scrapes off the toner adhering to the transfer belt 461 to clean the transfer belt 461. A toner box 466 stores the toner scraped off from the transfer belt 461 by the cleaning blade 465.

A fixing portion 500 is provided on a downstream side of the image forming portion 400 along the conveying path of the sheet 101 (606). The fixing portion 500 includes an upper roller 501 and a lower roller 502. The upper roller 501 has a surface layer formed of a resilient body, and is provided with a halogen lamp 503*a* as an internal heat source. The lower roller 502 has a surface layer formed of a resilient body, and is provided with a halogen lamp 503*b* as an internal heat source. The fixing portion 500 applies heat and pressure to the toner image on the sheet 101 (606) conveyed from the image forming portion 400, so as to cause the toner to be molten and fixed to the sheet 101 (606). Operations of respective parts of the fixing portion 500 are controlled by a not shown fixing control unit.

The sheet 101 to which the toner image is fixed is conveyed by ejection rollers 504*a*, 504*b* and 504*c*, and ejected to a stacker portion 505 provided on an upper cover of the image forming apparatus 700. A sheet sensor 506 is provided on a downstream side of the fixing portion 500. The sheet sensor 506 is used to detect a timing to start rotating the ejection rollers 504*a*, 504*b* and 504*c*.

A configuration of the MPT 600 will be described with reference to FIGS. 2, 3 and 4.

Figure 2:
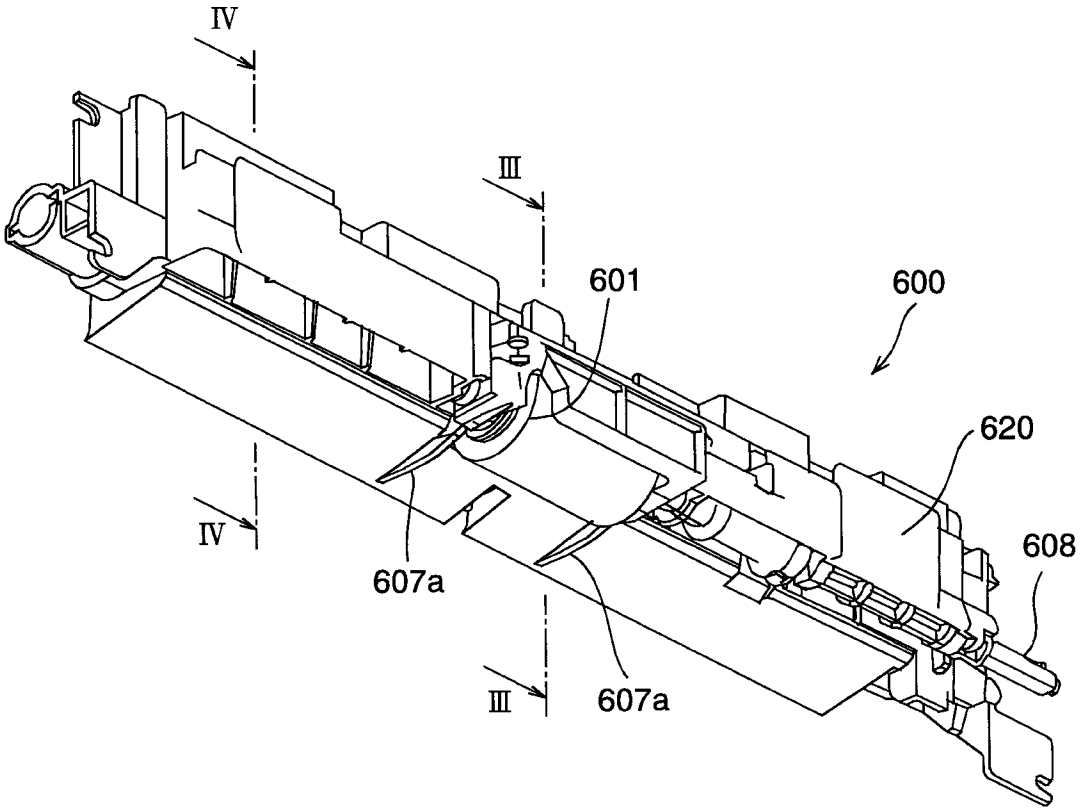
FIG. 2 is a perspective view showing a multi-purpose tray according to the first embodiment.

FIG. 2 is a perspective view showing the MPT 600. FIG. 3 is a sectional view of a center part of the MPT 600 taken along line III-III in FIG. 2. FIG. 4 is a sectional view of a side part of the MPT 600 taken along line IV-IV in FIG. 2. In this regard, the term "center part" is used to mean a center part in a direction perpendicular to the conveying direction of the sheet 606. The term "side part" is used to mean a side part in a direction perpendicular to the conveying direction of the sheet 606.

As shown in FIG. 2, the sheet feeding roller 601 (i.e., the medium feeding unit) is supported by a rotation shaft 608 rotatably mounted to a frame 620 of the MPT 600. The sheet feeding roller 601 is a rubber roller or the like, and is driven by a not shown driving source. The sheet feeding roller 601 is provided at a part (more specifically, a center part) of the MPT 600 in the direction perpendicular to the conveying direction of the sheet 606.

Figure 3:
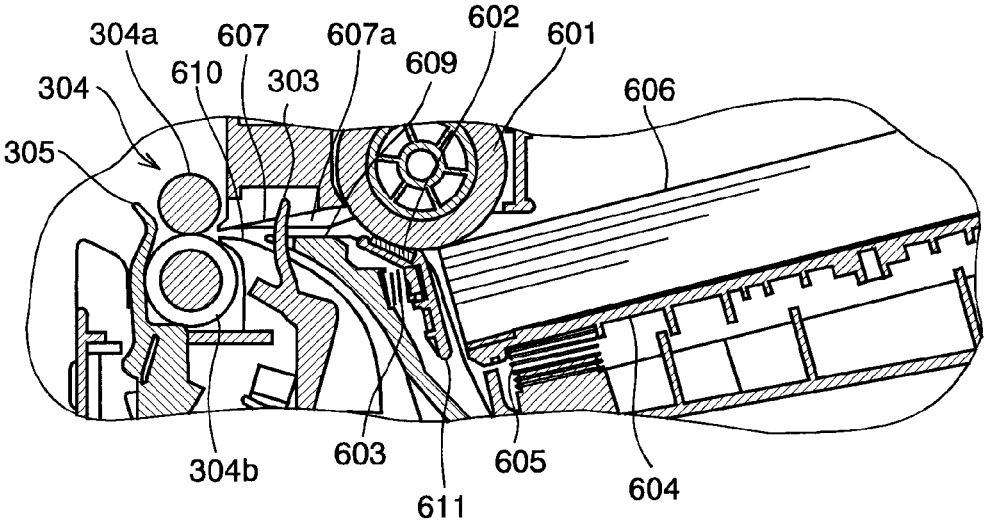
FIG. 3 is a sectional view of a center part of the multi-purpose tray according to the first embodiment taken along line in FIG. 2.
Figure 4:
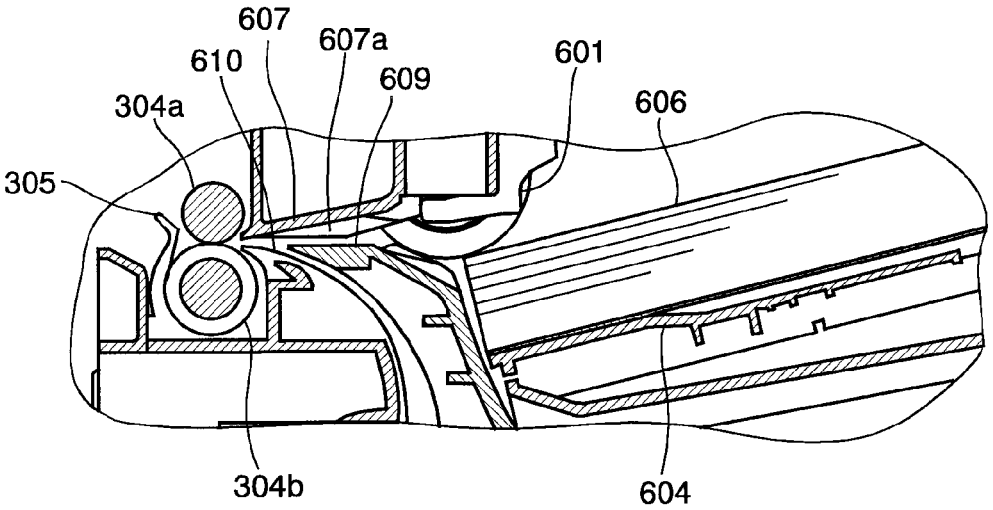
FIG. 4 is a sectional view of a side part of the multi-purpose tray according to the first embodiment taken along line IV-IV in FIG. 2.

As shown in FIG. 3, the friction pad 602 (i.e., the separating unit) is constituted by a friction piece, and is fixed to a pad frame 611. The pad frame 611 is supported by a not shown rotation shaft, and is pressed by a spring 603 in a direction in which the friction pad 602 is pressed against the sheet feeding roller 601. The friction pad 602 has a width (in the direction perpendicular to the conveying direction of the sheet 606) which is substantially the same as or slightly greater than a length of the sheet feeding roller 601.

The sheet placing plate 604 is rotatably supported, and is configured so that a stack of the sheets 606 is placed thereon. The sheet placing plate 604 is pressed by a spring 605 so that the uppermost sheet 606 of the stack abuts against the sheet feeding roller 601. The sheet feeding roller 601 contacts a center part of the sheet 606, and rotates to feed the sheet 606.

The sheet 606 is pressed against the sheet feeding roller 601, and is fed by the rotation of the sheet feeding roller 601. The sheet 606 is pressed against the sheet feeding roller 601 by the friction pad 602, and is therefore separated from the subsequent sheets 606. That is, the sheet 606 is individually fed out from the sheet placing plate 604.

The conveying roller pair 304 includes a pinch roller 304*a* and a conveying roller 304*b*. The pinch roller 304*a* is constituted by a metal roller, and the conveying roller 304*b* is constituted by a rubber roller. The pinch roller 304*a* is pressed against the conveying roller 304*b* by a not shown biasing member. The pinch roller 304*a* and the conveying roller 304*b* nip the sheet 606 (individually fed by the sheet feeding roller 601 and the friction pad 602) therebetween, and convey the sheet 606 to a downstream side with a certain conveying force.

Between the sheet feeding roller 601 and the conveying roller pair 304, an upper guide 607 as a first guide member, a lower guide 609 as a second guide member, and a guide frame 610 are provided for guiding the sheet 606 to be conveyed. The upper guide 607 guides an upper surface (facing the sheet feeding roller 601) of the sheet 606. The lower guide 609 is provided so as to face the upper guide 607, and guides a lower surface of the sheet 606. The guide frame 610 guides the lower surface of the sheet 606 at a downstream side of the lower guide 609. The guide frame 610 is formed integrally with the frame 620 that rotatably supports the sheet feeding roller 601.

A space between the upper guide 607 and the lower guide 609 provides a travelling path of the sheet 606 fed by the sheet feeding roller 601. Further, a space between the lower guide 609 and the guide frame 610 provides a travelling path of the sheet 101 conveyed from the above described sheet tray 100.

Guide ribs 607*a* as guide protruding portions are provided at a center part of the upper guide 607 in the direction perpendicular to the conveying direction of the sheet 606. That is, the guide ribs 607*a* are located in the vicinity of the sheet feeding roller 601. The guide ribs 607*a* are located between the sheet feeding roller 601 and the conveying roller pair 304. As shown in FIG. 2, the guide ribs 607*a* protrude downward with respect to the other parts of the upper guide 607 toward the travelling path of the sheet 606 fed by the sheet feeding roller 601, i.e., toward the lower guide 609. Each guide rib 607*a* has a sufficient inclination along the travelling path of the sheet 606 so as not to interfere with the sheet 606 fed by the sheet feeding roller 601.

The upper guide 607 and the lower guide 609 face each other with a gap formed therebetween. With the provision of the guide rib 607*a*, the gap between the upper guide 607 and the lower guide 609 is narrower at a part in the vicinity of a downstream side of the sheet feeding roller 601 than the other parts of the gap.

The above described sheet feeding roller 601, the friction pad 602, the sheet placing plate 604, the upper guide 607 (with the guide rib 607*a*), the lower guide 607*b*, the conveying roller pair 304 and the like constitute a medium feeding device of the MPT 600.

An operation of the above configured MPT 600 will be described.

FIGS. 5A through 5D are sectional views showing an operation of the center part of the MPT 600 of the first embodiment, and more specifically, a movement of the sheet 606 at a position corresponding to line III-III in FIG. 2. FIGS. 6A through 6D are sectional views showing an operation of the side part of the MPT 600 of the first embodiment, and more specifically, a movement of the sheet 606 at a position corresponding to line IV-IV in FIG. 2.

Figure 5A:
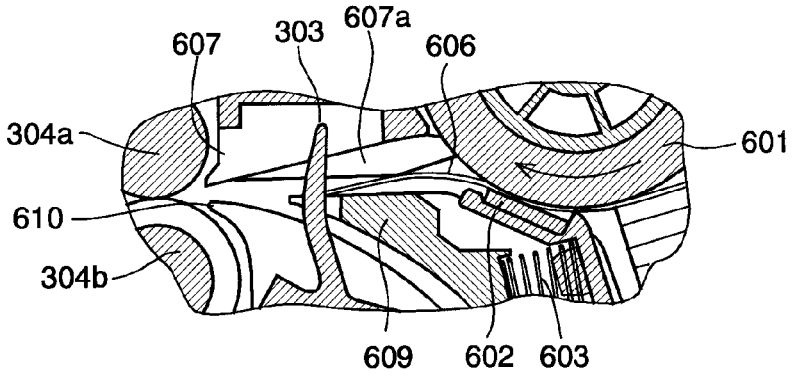
FIGS. 5A through 5D are sectional views showing an operation of the center part of the multi-purpose tray according to the first embodiment.

In FIGS. 5A through 6D, when the sheet feeding roller 601 rotates clockwise, the uppermost sheet 606 of the stack placed on the sheet placing plate 604 is fed to the left, i.e., toward the conveying roller pair 304 (304*a*, 304*b*). The sheet 606 is separated from the subsequent sheets 606 by the friction pad 602, and is fed downstream. The center part of the sheet 606 is fed to the conveying roller pair 304 (304*a*, 304*b*) in such a manner that the upper surface of the center part of the sheet 606 contacts the guide rib 607*a* as shown in FIG. 5A. In contrast, the side part of the sheet 606 is fed substantially straightly to the conveying roller pair 304 (304*a*, 304*b*) as shown in FIG. 6A.

Figure 5B:
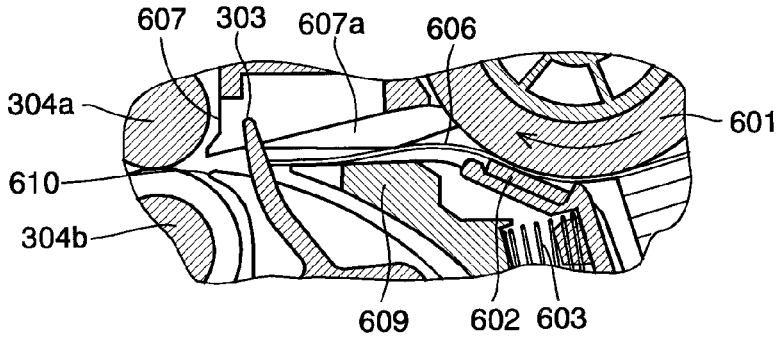
Figure 5C:
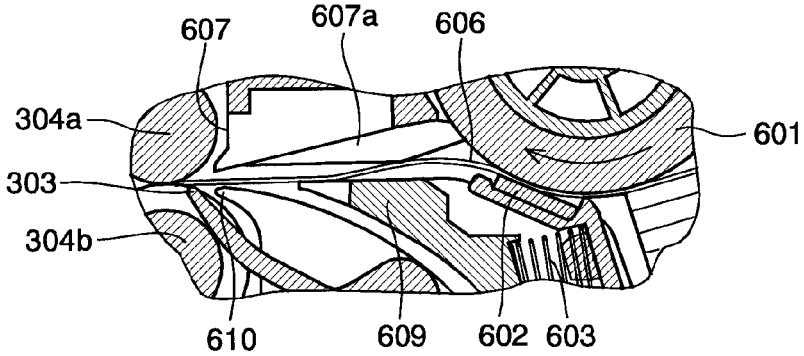
Figure 6A:
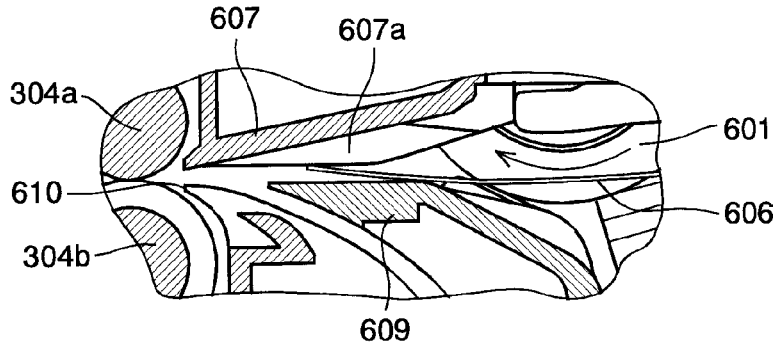
FIGS. 6A through 6D are sectional views showing an operation of the side part of the multi-purpose tray according to the first embodiment.
Figure 6B:
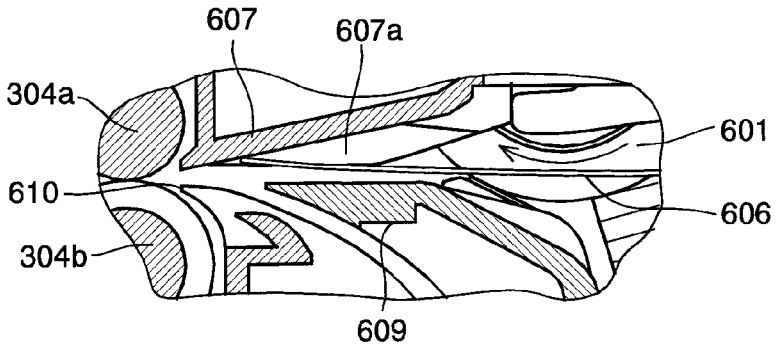
Figure 6C:
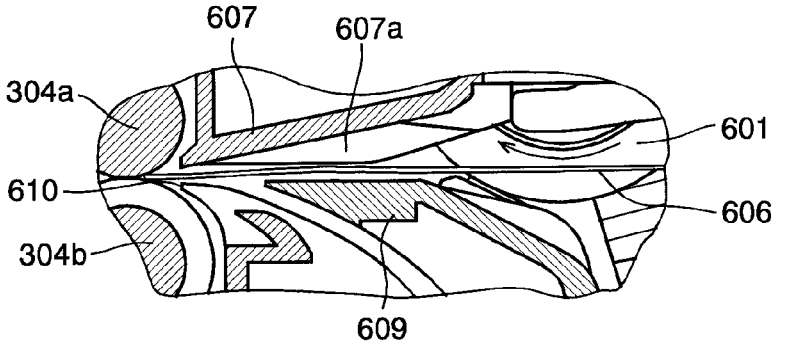

When the sheet feeding roller 601 further rotates, the sheet 606 is further fed as shown FIGS. 5B and 6B, and a leading end of the sheet 606 contacts a contact portion (i.e., a nip portion) of the conveying roller pair 304 (304*a*, 304*b*) as shown in FIGS. 5C and 6C. In this state, the center part of the sheet 606 is fed to the conveying roller pair 304 in such a manner that the upper surface of the center part of the sheet 606 contacts the guide rib 607*a* as shown in FIG. 5C. In contrast, the side part of the sheet 606 is fed substantially straightly to the conveying roller pair 304 (304*a*, 304*b*) as shown in FIG. 6C.

Figure 5D:
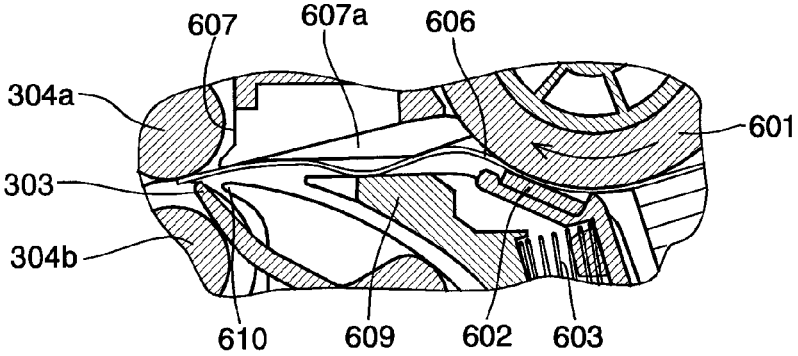
Figure 6D:
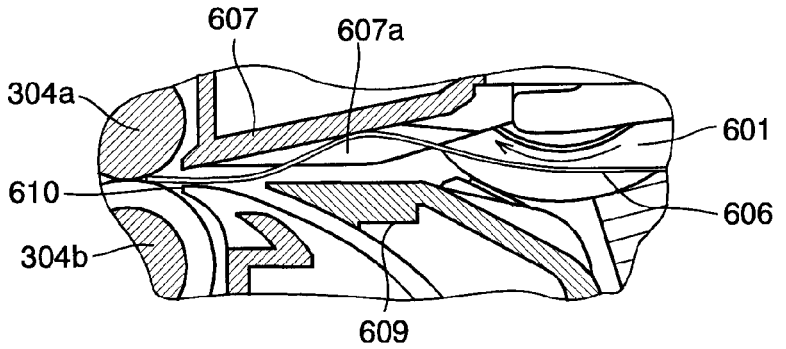

From this state, the sheet feeding roller 601 slightly feeds the sheet 606 so as to push the sheet 606 into the nip portion of the conveying roller pair 304 (304*a*, 304*b*) as shown in FIGS. 5D and 6D. Therefore, even when the sheet 606 is skewed, the skew is corrected by the conveying roller pair 304, and the leading end of the sheet 606 becomes parallel to the nip portion of the conveying roller pair 304.

Then, the sheet feeding roller 601 stops rotating, and the conveying roller pair 304 (304*a*, 304*b*) starts rotating to convey the sheet 606 further downward. The sheet feeding roller 601 has a sliding mechanism (not shown) therein, and rotates following the sheet 606 conveyed by the conveying roller pair 304, so as not to increase a load for conveying the sheet 606.

Here, an operation of a MPT of a comparison example having no guide rib 604*a* will be described with reference to FIG. 7 through 10C.

Figure 7:
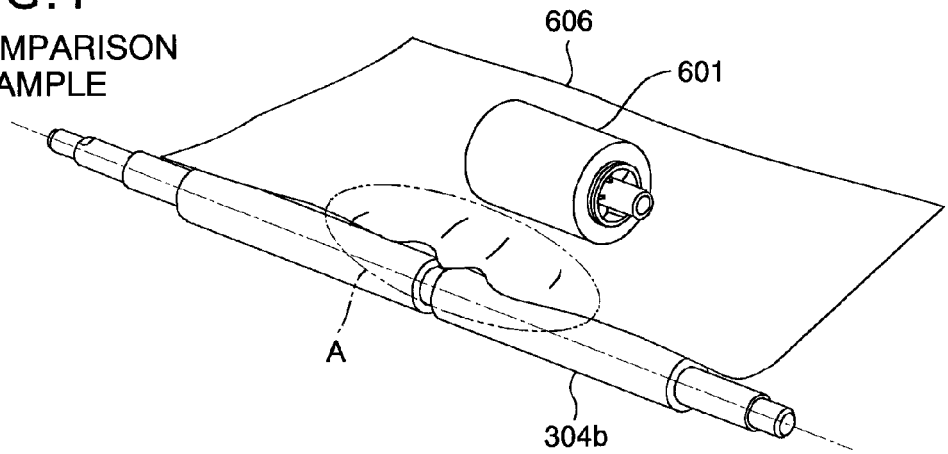
FIG. 7 is a schematic view for illustrating an operation of a multi-purpose tray of a comparison example.
Figure 8A:
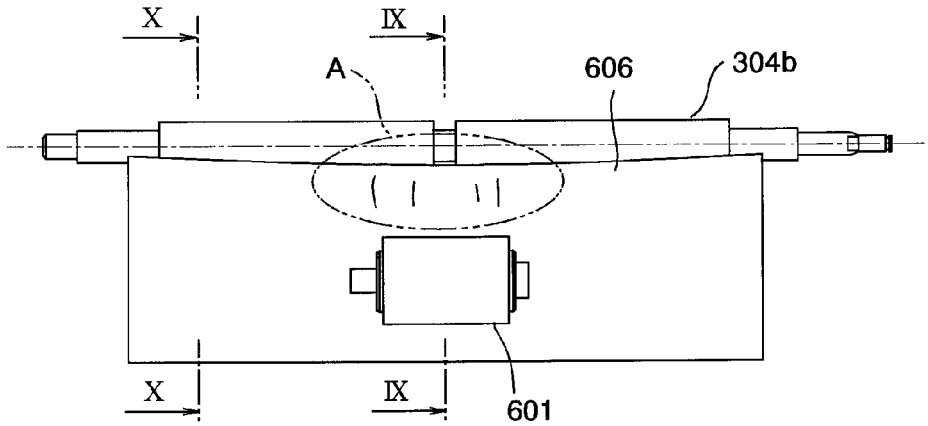
FIG. 8A is a plan view for illustrating the operation of the multi-purpose tray of the comparison example.
Figure 9A:
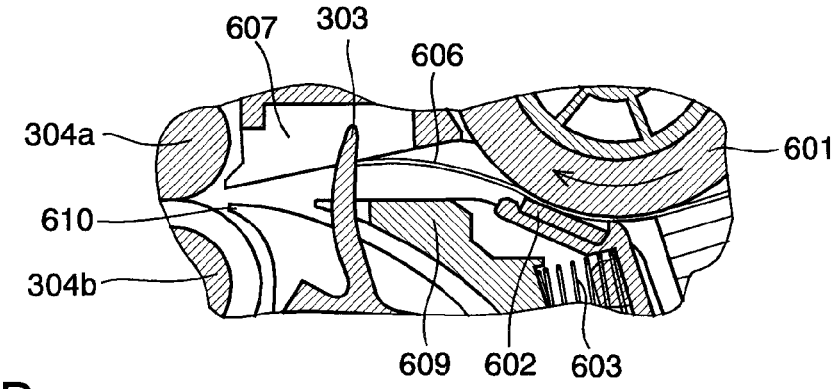
FIGS. 9A through 9C are schematic views showing an operation of a center part of the multi-purpose tray of the comparison example.
Figure 9B:
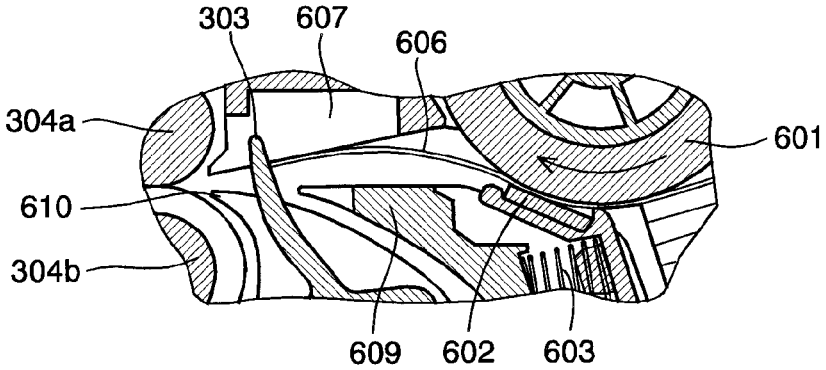
Figure 9C:
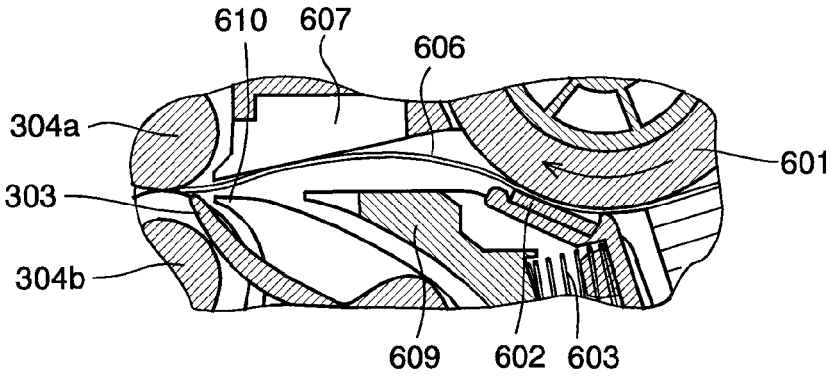
Figure 10A:
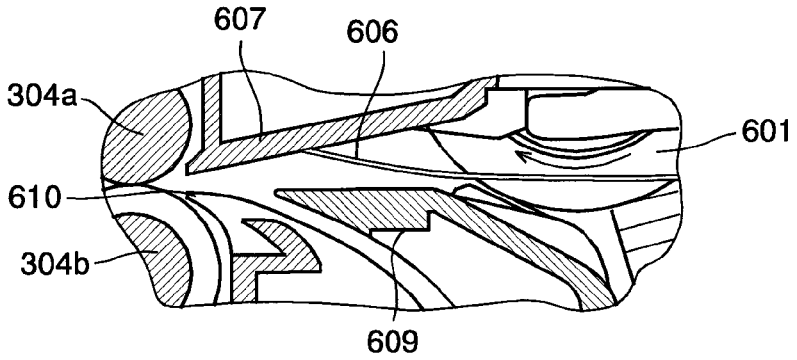
FIGS. 10A through 10C are schematic views showing an operation of a side part of the multi-purpose tray of the comparison example.

FIG. 7 is a schematic view for illustrating the operation of the MPT of the comparison example. More specifically, FIG. 7 shows a state where the sheet 606 is fed to the vicinity of the conveying roller pair 304 in the comparison example. FIG. 8A is a plan view of the MPT shown in FIG. 7 as seen from above. FIGS. 9A through 9C are schematic views showing an operation of a center part of the MPT of the comparison example, and more specifically, a movement of the sheet 606 at a position corresponding to line IX-IX in FIG. 8A. FIGS. 10A through 100 are schematic views showing an operation of a side part of the MPT of the comparison example, and more specifically, a movement of the sheet 606 at a position corresponding to line X-X in FIG. 8A.

The sheet 606 is fed by the sheet feeding roller 601 to a downstream side, while the sheet 606 is separated from the subsequent sheets 606 by the friction pad 602. The center part of the sheet 606 is fed in a direction of a tangential line of the sheet feeding roller 601 and the friction pad 602 to the conveying roller pair 304 (304*a*, 304*b*) in such a manner that an upper surface of the center part of the sheet 606 contacts the upper guide 607 as shown in FIG. 9A. In contrast, the side part of the sheet 606 is fed substantially straightly to the conveying roller pair 304 (304*a*, 304*b*) as shown in FIG. 10A.

Figure 10B:
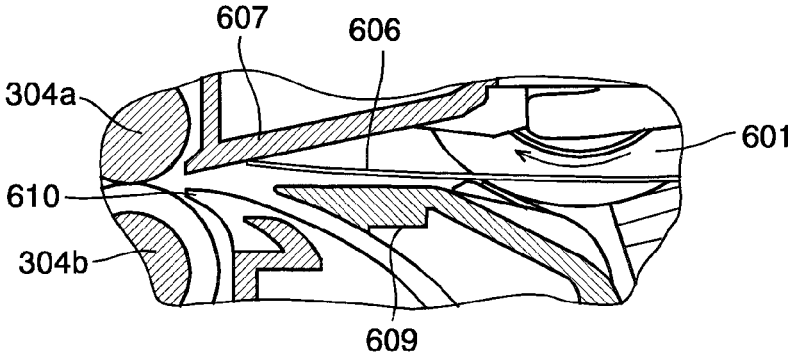
Figure 10C:
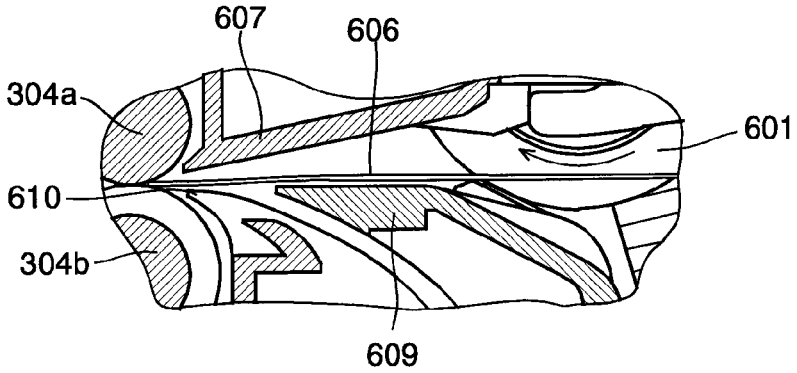

When the sheet feeding roller 601 further rotates, the sheet 606 is further fed as shown FIGS. 9B and 10B, and the leading end of the sheet 606 contacts the contact portion (i.e., a nip portion) of the conveying roller pair 304 (304*a*, 304*b*) as shown in FIGS. 9C and 10C. In this state, the center part of the sheet 606 is curved so as to form a chevron shape while the upper surface of the center part of the sheet 606 contacts the upper guide 607 as shown in FIG. 9C. In contrast, the side part of the sheet 606 is fed substantially straightly to the conveying roller pair 304 (304*a*, 304*b*) as shown in FIG. 10C.

By comparing the states of the sheet 606 shown in FIGS. 9C and 10C with each other, the center part of the sheet 606 is curved as shown in FIG. 9C, while the side part of the sheet 606 is substantially straight as shown in FIG. 10C. Therefore, it is understood that the center part of the sheet 606 travels a longer distance to reach the conveying roller pair 304 than the side part of the sheet 606.

As the center part and the side part of the sheet 606 travel different distances to reach the conveying roller pair 304, wrinkles may be formed on the center part of the sheet 606 as shown in FIG. 7 (see, an area encircled by a dashed line A). In other words, the center part of the sheet 606 reaches the conveying roller 704*a* with a delay with respect to both side parts of the sheet 606 as shown in FIG. 8A. If the sheet 606 is nipped between the pinch roller 304*a* and the conveying roller 304*b* of the conveying roller pair 304 in this state, the wrinkles on the center part of the sheet 606 may be crushed, and may result in poor printing.

In contrast, according to the first embodiment, the upper guide 607 has the above described guide rib 607*a*, and therefore the center part and the side part of the sheet 606 travel substantially the same distances to reach the conveying roller pair 304 as shown in FIGS. 5C and 6C.

Figure 8B:
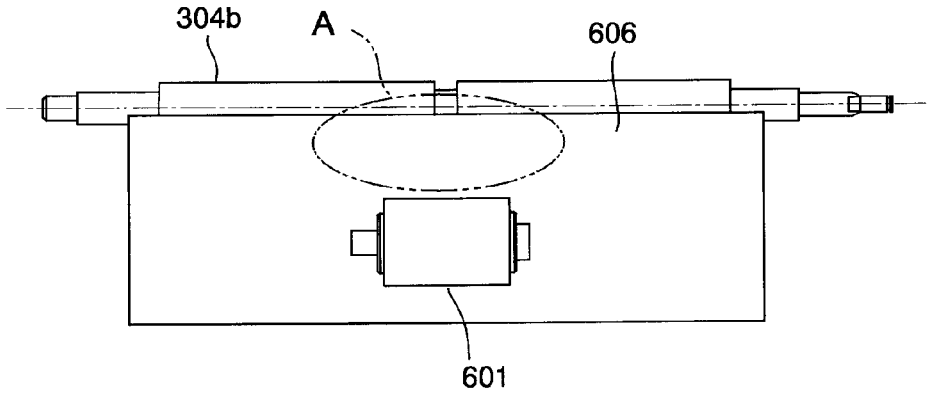
FIG. 8B is a plan view for illustrating the operation of the multi-purpose tray of the first embodiment.

Since the center part and the side part of the sheet 606 travel substantially the same distances to reach the conveying roller pair 304, the leading end of the sheet 606 is parallel to the conveying roller 304*b* as shown in FIG. 8B when the leading end of the sheet reaches the nip portion of the conveying roller pair 304 (304*a*, 304*b*). Thus, no wrinkles are formed on the sheet 606 when the sheet 606 is nipped by the conveying roller pair 304 (304*a*, 304*b*), and poor printing can be therefore prevented.

As described above, the guide ribs 607*a* are provided at the center part of the upper guide 607 in the direction perpendicular to the conveying direction of the sheet 606 so as to limit the center part of the travelling path the sheet 606, and therefore the distances traveled by the center part and the side part of the sheet 606 can be substantially the same. Thus, formation of wrinkles on the sheet 606 can be prevented, and excellent printing quality can be obtained. Further, since it is unnecessary to provide an anti-wrinkle roller or anti-wrinkle guide (that may cause an increase in conveying load), the sheet 606 can be smoothly conveyed even when the sheet 606 is thick.

In the above first embodiment, guide ribs 607*a* of the upper guide 607 are located on both sides of the sheet feeding roller 601 as shown in FIG. 2. However, the following modifications may be made.

Figure 11:
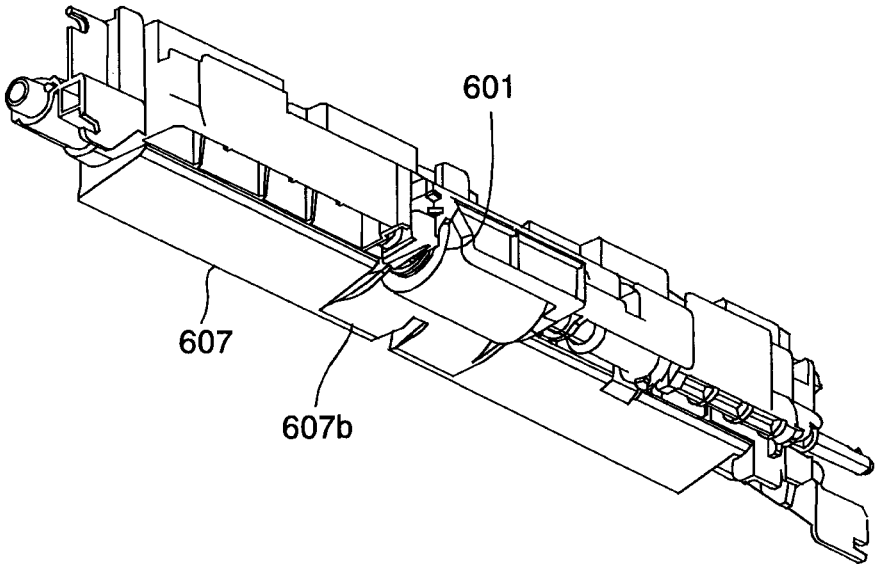
FIG. 11 is a perspective view showing a multi-purpose tray according to a modification of the first embodiment.

As shown in FIG. 11, the guide ribs 607*a* can be replaced with a guide surface 607*b* having a relatively wide width and located at the center part of the upper guide 607 in the direction perpendicular to the conveying direction of the sheet 606.

Figure 12:
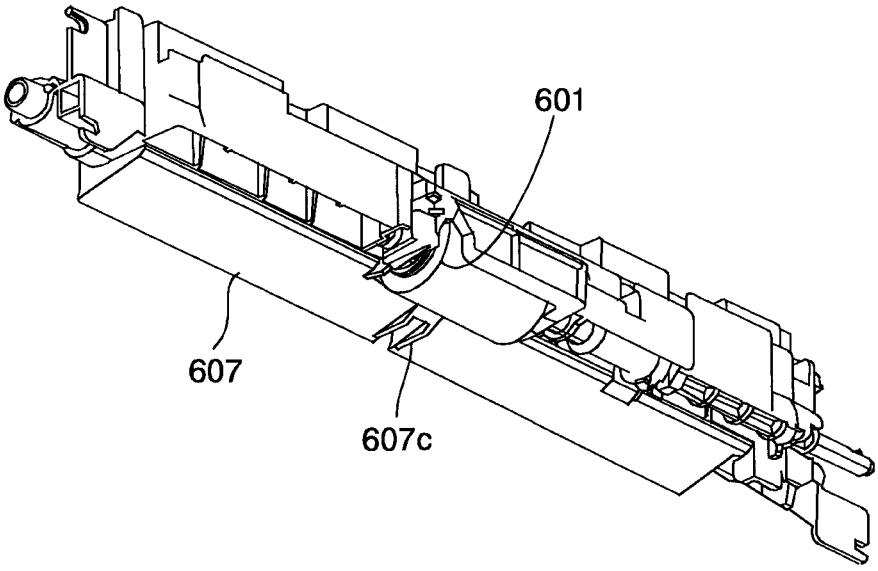
FIG. 12 is a perspective view showing a multi-purpose tray according to another modification of the first embodiment.

Further, as shown in FIG. 12, the guide ribs 607*a* can be replaced with a guide rib 607*c* provided at the center part of the sheet feeding roller 601 in the direction perpendicular to the conveying direction of the sheet 606.

As described above, according to the first embodiment of the present invention, the guide rib is provided at the center part of the upper guide in the direction perpendicular to the conveying direction of the sheet so as to limit the travelling path of the sheet at the center part, and therefore the distances traveled by the center part and the side part of the sheet can be substantially the same. Thus, generation of wrinkles on the sheet can be prevented, and excellent printing quality can be obtained. Further, since it is unnecessary to provide an anti-wrinkle roller or guide (that may cause an increase in conveying load), the sheet can be smoothly conveyed even when the sheet is thick.

Second Embodiment

Next, the second embodiment of the present invention will be described. The second embodiment is different from the first embodiment in that the guide rib of the upper guide is movable, and is biased toward the travelling path of the sheet.

Figure 13:
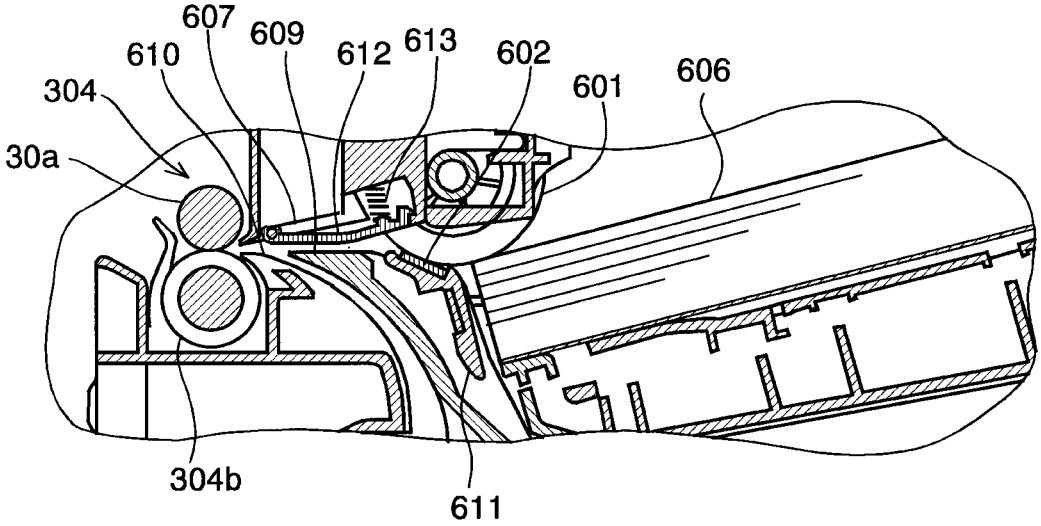
FIG. 13 is a sectional view showing a multi-purpose tray according to the second embodiment.

FIG. 13 is a sectional view of a MPT according to the second embodiment. Elements of the second embodiment that are the same as those of the first embodiment are assigned the same reference numerals, and duplicate explanations will be omitted. Further, explanations of operations and advantages which are the same as those of the first embodiment will be omitted.

As shown in FIG. 13, an end portion of the guide rib 612 is supported by a rotation shaft 614 provided on the upper guide 607 so that the guide rib 612 is movable (more specifically, rotatable). A spring 613 as a biasing member biases the guide rib 612 downward, i.e., in a direction toward the travelling path of the sheet 606 (i.e., toward the lower guide rib 609).

A contacting side of the guide rib 612 which is to contact the sheet 606 protrude downward, i.e., in a direction toward the travelling path of the sheet 606, as is the case with the guide rib 607*a* of the first embodiment. Further, the guide rib 612 has a sufficient inclination along the travelling path of the sheet 606 so as not to interfere with the sheet 606 fed by the sheet feeding roller 601. A downward movement of the guide rib 612 is limited by a movement limiting member (not shown), and the guide rib 612 is normally held at a position shown in FIG. 13 so as to provide a space through which the sheet 606 pass.

In the second embodiment, the guide ribs 612 of the upper guide 607 are located on both sides of the sheet feeding roller 601 as is the case with the guide ribs 607*a* of the first embodiment (FIG. 2). However, the modifications shown in FIGS. 11 and 12 may be made to the second embodiment. For example, it is possible to form the guide rib 612 at the center part of sheet feeding roller 601.

An operation of the MPT of the second embodiment will be described.

FIGS. 14A through 14D are schematic views showing the operation of the center part of the MPT.

Figure 14A:
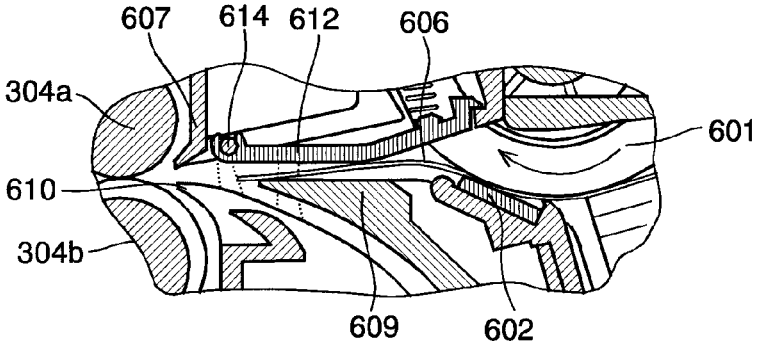
FIGS. 14A through 14D are schematic views showing an operation of the multi-purpose tray according to the second embodiment.
Figure 14B:
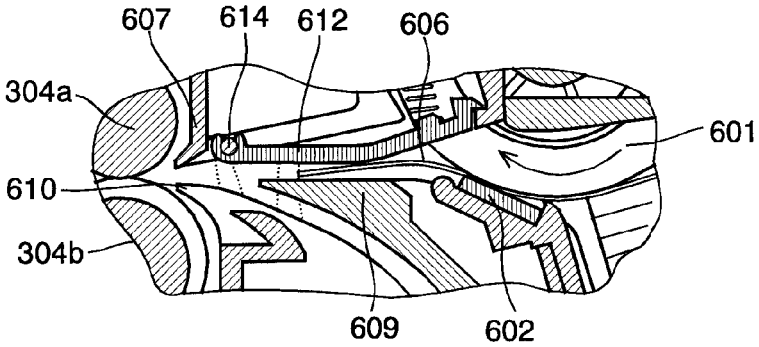
Figure 14C:
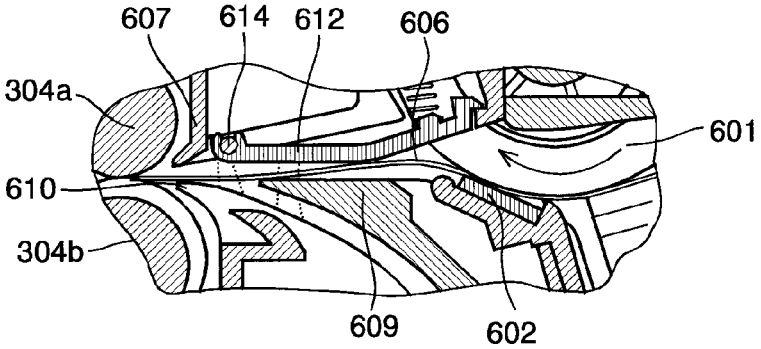
Figure 14D:
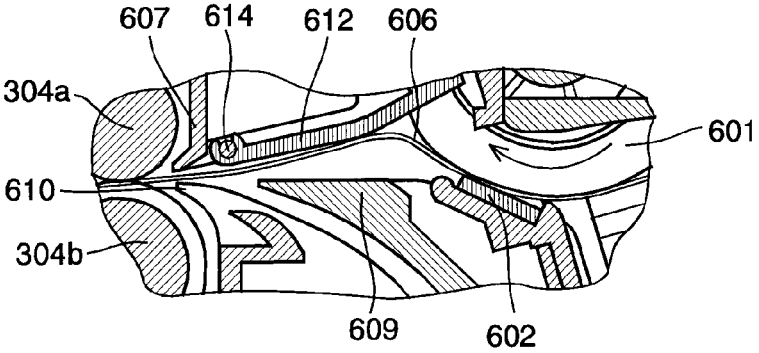

FIGS. 14A, 14B and 14C show respective states while the sheet 606 is fed to reach the conveying roller pair 304 as described in the first embodiment. FIG. 14D shows a state where the sheet feeding roller 601 further feeds the sheet 606 to push the sheet 606 into the nip portion of the conveying roller pair 304 (304*a*, 304*b*) so as to correct the skew of the sheet 606. In this state, the guide rib 612 is pushed by the curved sheet 606 and moves upward, and creates a space in which the sheet 606 can be further curved.

By comparing the states of the sheet 606 shown in FIGS. 5D and 14D with each other, it is understood that the sheet 606 can be curved in the second embodiment more than that in the first embodiment, and therefore the sheet 606 is not subjected to excessive stress.

As described above, since the guide rib 612 is configured to be movable, a sufficient space is created so that the sheet 606 can be curved when the sheet 606 is pushed into the nip portion of the conveying roller pair 304. Therefore, correction of the skew of the sheet 606 can be more effectively performed. Further, an impact noise when the sheet 606 contacts the upper guide 607 can be reduced.

As described above, according to the second embodiment of the present invention, the guide rib is configured to be movable, and a sufficient space is created so as to allow the sheet to be curved when the sheet is pushed into the nip portion of the conveying roller pair. Therefore, in addition to the advantages of the first embodiment, correction of the skew of the sheet can be more effectively performed, and an impact noise when the sheet contacts the upper guide can be reduced.

In the above described embodiments and modifications thereof, one or two guide rib(s) is provided. However, the number of the guide rib(s) can be arbitrarily determined.

In the above described embodiments, although the guide ribs 607*a* are provided at the center part of the upper guide 607, the guide ribs 607*a* can be provided to other part. In this regard, it is preferable to provide the guide ribs 607*a* in the vicinity of the sheet feeding roller 601 in terms of advantage in preventing generation of wrinkles.

Furthermore, in the above described embodiments, the image forming apparatus includes four process units and is configured to transfer the toner image directly to the medium. However, the present invention is not limited to such a configuration, but is applicable to an apparatus that performs an operation on a medium which is conveyed, for example, a color image forming apparatus having an intermediate transfer belt, a single color image forming apparatus having a single process unit. The present invention is also applicable to a copier, a combined machine, an automatic manuscript reader and the like using such an apparatus.

While the preferred embodiments of the present invention have been illustrated in detail, it should be apparent that modifications and improvements may be made to the invention without departing from the spirit and scope of the invention as described in the following claims.

What is claimed is:

1. A medium feeding device comprising:

a medium feeding unit that feeds a medium in a first direction by contacting a first surface of said medium;

a separating unit that contacts a second surface of said medium and presses said medium against said medium feeding unit to separate said medium from subsequent media;

a conveying unit that conveys said medium having been separated by said separating unit, said conveying unit being disposed downstream of said medium feeding unit and said separating unit in said first direction;

a first guide member provided between said medium feeding unit and said conveying unit, and configured to guide said first surface of said medium, and a second guide member provided so as to face said first guide member, and configured to guide said second surface of said medium, wherein said first guide member has a guide protruding portion that protrudes toward said second guide member without contacting said second guide member, said guide protruding portion comprised of a rib, said guide protruding portion being located on an extended line of a tangential line at a contact portion between said medium feeding unit and said separating unit, wherein a part of said guide protruding portion overlaps with said medium feeding unit as seen in a second direction perpendicular to said first direction.

2. The medium feeding device according to claim 1, wherein said medium feeding unit and said separating unit are arranged in such a manner that said medium separated by said separating unit is fed toward said first guide member.

3. The medium feeding device according to claim 1, wherein said medium feeding unit contacts a center portion of said first surface of said medium in said second direction, and wherein said guide protruding portion of said first guide member is located in the vicinity of said medium feeding unit, and extends in said first direction.

4. The medium feeding device according to claim 3, wherein said medium feeding unit includes a rotatable medium feeding roller, and wherein a plurality of said guide protruding portions are provided on both sides of said medium feeding roller.

5. The medium feeding device according to claim 1, wherein said guide protruding portion is movable with respect to said first guide member.

6. The medium feeding device according to claim 5, wherein said guide protruding portion is pressed in a direction toward said second guide member.

7. An image forming apparatus comprising:

said medium feeding device according to claim 1.

8. The medium feeding device according to claim 1, wherein said guide protruding portion has an inclined portion on said extended line of said tangential line, said inclined portion contacting a leading end of said medium fed by said medium feeding unit, wherein a part of said inclined portion overlaps with said medium feeding unit as seen in said second direction.

9. The medium feeding device according to claim 8, wherein a distance between said inclined portion and said second guide member decreases in said first direction.

10. The medium feeding device according to claim 1, wherein said guide protruding portion is located so that a leading end of said medium having passed said medium feeding unit first contacts said guide protruding portion.

11. The medium feeding device according to claim 1, wherein said separation unit includes a friction pad.

12. A medium feeding device comprising:

a medium feeding unit that feeds a medium in a first direction by contacting a first surface of said medium;

a separating unit that contacts a second surface of said medium and presses said medium against said medium feeding unit to separate said medium from subsequent media;

a conveying unit that conveys said medium having been separated by said separating unit;

a first guide member provided between said medium feeding unit and said conveying unit, and configured to guide said first surface of said medium, and a second guide member provided so as to face said first guide member, and configured to guide said second surface of said medium, wherein said first guide member has a guide protruding portion that protrudes toward said second guide member without contacting said second guide member, said guide protruding portion being located on an extended line of a tangential line at a contact portion between said medium feeding unit and said separating unit, wherein said guide protruding portion overlaps with said medium feeding unit as seen in said first direction, wherein said guide protruding portion is movable with respect to said first guide member and is pressed in a direction toward said second guide member.

13. The medium feeding device according to claim 12, wherein said medium feeding unit and said separating unit are arranged in such a manner that said medium separated by said separating unit is fed toward said first guide member.

14. The medium feeding device according to claim 12, wherein said medium feeding unit contacts a center portion of said first surface of said medium in a second direction perpendicular to said first direction, and wherein said guide protruding portion of said first guide member is located in the vicinity of said medium feeding unit, and extends in said first direction.

15. The medium feeding device according to claim 14, wherein said medium feeding unit includes a rotatable medium feeding roller, and wherein said guide protruding portion is disposed downstream of said medium feeding roller in said first direction.

16. The medium feeding device according to claim 12, wherein said guide protruding portion has an inclined portion on said extended line of said tangential line, said inclined portion contacting a leading end of said medium fed by said medium feeding unit.

17. The medium feeding device according to claim 16, wherein a distance between said inclined portion and said second guide member decreases in said first feeding direction.

18. The medium feeding device according to claim 12, wherein said guide protruding portion is located so that a leading end of said medium having passed said medium feeding unit contacts said guide protruding portion.

19. The medium feeding device according to claim 12, wherein said separating unit includes a separation pad.

20. An image forming apparatus comprising:

said medium feeding device according to claim 12.

* * * * *